US008693284B2

(12) United States Patent
Allan et al.

(10) Patent No.: US 8,693,284 B2
(45) Date of Patent: Apr. 8, 2014

(54) APPARATUS FOR CREATING PRESSURE PULSES IN THE FLUID OF A BORE HOLE

(75) Inventors: Victor Laing Allan, Aberdeenshire (GB); William Peter Stuart-Bruges, Newbury (GB)

(73) Assignee: Sondex Limited (GB)

( * ) Notice: Subject to any disclaimer, the term of this patent is extended or adjusted under 35 U.S.C. 154(b) by 1123 days.

(21) Appl. No.: 12/513,278

(22) PCT Filed: Oct. 19, 2007

(86) PCT No.: PCT/GB2007/004002
§ 371 (c)(1),
(2), (4) Date: Jan. 12, 2010

(87) PCT Pub. No.: WO2008/053155
PCT Pub. Date: May 8, 2008

(65) Prior Publication Data

US 2010/0157735 A1 Jun. 24, 2010

(30) Foreign Application Priority Data

Nov. 2, 2006 (GB) ..... 0621912.5

(51) Int. Cl.
*E21B 47/18* (2012.01)

(52) U.S. Cl.
USPC ..... 367/84; 367/81; 367/83

(58) Field of Classification Search
USPC ..... 367/81, 83, 84
See application file for complete search history.

(56) References Cited

U.S. PATENT DOCUMENTS

| | | | | | |
|---|---|---|---|---|---|
| 3,705,603 | A | * | 12/1972 | Hawk | 137/624.14 |
| 4,519,574 | A | * | 5/1985 | Roper | 251/31 |
| 4,550,392 | A | * | 10/1985 | Mumby | 367/82 |
| 4,630,244 | A | * | 12/1986 | Larronde | 367/84 |
| 4,742,498 | A | * | 5/1988 | Barron | 367/85 |
| 4,869,100 | A | * | 9/1989 | Birdwell | 367/85 |
| 5,020,609 | A | * | 6/1991 | Jeter | 175/48 |
| 5,073,877 | A | * | 12/1991 | Jeter | 367/84 |
| 5,103,430 | A | * | 4/1992 | Jeter et al. | 367/85 |
| 5,115,415 | A | * | 5/1992 | Mumby et al. | 367/85 |
| 5,117,398 | A | * | 5/1992 | Jeter | 367/85 |
| 5,182,731 | A | * | 1/1993 | Hoelscher et al. | 367/84 |
| 5,333,686 | A | * | 8/1994 | Vaughan et al. | 175/45 |

(Continued)

FOREIGN PATENT DOCUMENTS

GB 1378871 A 12/1974

OTHER PUBLICATIONS

PCT/GB2007/004002; International Search Report; International Filing Date Oct. 19, 2007.

*Primary Examiner* — Hai Phan
*Assistant Examiner* — Amine Benlagsir
(74) *Attorney, Agent, or Firm* — Global Patent Operation; Joanna M. Dombrowski

(57) ABSTRACT

An apparatus for creating pressure pulses in the fluid of a bore hole is described. The preferred embodiment takes the form of a mud pulser apparatus having a signalling valve controlled by a variable pilot valve. The forces on the signalling valve are balanced and controlled by the flow of mud through the variable orifice of the pilot valve. The arrangement is such as to act like a hydraulic amplifier, and results in the signalling valve being compensated for variable flow rates. In the preferred embodiment, the pilot valve has rotary vanes that allow it to be self-cleaning.

12 Claims, 3 Drawing Sheets

(56) References Cited

U.S. PATENT DOCUMENTS

| | | | | |
|---|---|---|---|---|
| 5,787,052 | A * | 7/1998 | Gardner et al. | 367/84 |
| 5,802,011 | A * | 9/1998 | Winters et al. | 367/83 |
| 6,016,288 | A * | 1/2000 | Frith | 367/85 |
| 6,089,332 | A * | 7/2000 | Barr et al. | 175/45 |
| 6,850,463 | B2 * | 2/2005 | Winnacker | 367/83 |
| 7,057,524 | B2 * | 6/2006 | Innes | 340/855.4 |
| 7,249,722 | B2 * | 7/2007 | Cibotti | 239/533.9 |
| 2004/0081019 | A1 * | 4/2004 | Innes | 367/83 |

* cited by examiner

APPARATUS FOR CREATING PRESSURE PULSES IN THE FLUID OF A BORE HOLE

This application claims the benefit of WO 2008053155 20080508, filed 19 Oct. 2007.

The invention relates to an apparatus for creating pressure pulses in the fluid of a bore hole, and in particular to devices known as mud pulsers.

The drilling of bore holes, used in wells for the extraction of hydrocarbons such as oil or gas for example, requires directional control of a down-hole drill bit. In order to do this, it is first necessary to know the current attitude of the lowest part of the drill pipe, normally referred to as the Bottom Hole Assembly (BHA), so that appropriate corrections to the drilling direction can be made. Down-hole sensors close to the drill bit are therefore provided for determining the attitude of the BHA and the drill bit. A convenient way of transmitting the data from these sensors to control instruments many miles away at the surface is via pressure pulses created in the drilling mud flowing within the drill pipe. Such measurements and telemetry are commonly referred to as Measurement While Drilling (MWD). The pulses are created by selectively restricting the flow of the drilling mud using a device known as a mud pulser.

A number of typical mud pulsers are described in U.S. Pat. No. 5,103,430, U.S. Pat. No. 5,115,415, U.S. Pat. No. 5,333,686, and U.S. Pat. No. 6,016,288. These mud pulsers are controlled by solenoid or motor lead screw actuators, in order to provide linear movement of a valve that selectively restricts the flow of the drilling mud in the bore hole. With the exception of U.S. Pat. No. 5,115,415, the actuator controls the flow of mud through a small pilot valve, and it is this flow of mud that provides the force needed to operate the main valve that creates the pulse.

There are several factors that affect the reliability of a mud pulser transmitter, such as the abrasive nature of the drilling mud, exacerbated by the high flow velocities and pressures, and a tendency for sliding seals in the device to wear out. Another factor is the tendency for orifices to become blocked with particulate matter within the mud. Operators often add such materials in order to block the pores of the rock formations being drilled, so that the expensive drilling mud is not lost but can be recovered from the bore hole via circulation in the annulus between the drill pipe and the bore hole wall. Such additives, which are typically fibrous, are referred to as Lost Circulation Material (LCM). Over time, LCM has become notorious for causing difficulties for MWD mud pulsers. A filter may be employed in the mud pulser to protect against LCM intrusion into its hydraulic parts, such as that shown in U.S. Pat. No. 5,333,686 mentioned above. However, it is not always practicable to provide a filter, and the filter itself may become obstructed during its operation by build up of material. We have therefore appreciated that there is a need for a mud pulser device that can operate in such adverse conditions with improved reliability.

Additionally, we have appreciated that, as mud pulsers typically draw their power from internal electrical batteries, it would be desirable to improve reliability while minimising the electrical power needed for operation. Lastly, we have appreciated that it is also desirable to provide a mud pulser that permits the generation of pressure signals that allow more complex signalling than simply on/off pulses. Such pressure signals may rely on continuous wave phase, amplitude or frequency modulation techniques.

SUMMARY OF THE INVENTION

The invention is defined in the independent claims to which reference should now be made. Advantageous features are set forth in the dependent claims.

BRIEF DESCRIPTION OF THE DRAWINGS

Preferred embodiments of the invention will now be described in more detail, by way of example, and with reference to the drawings in which.

DETAILED DESCRIPTION

A preferred embodiment of an apparatus for creating pressure pulses in the fluid of a bore hole will now be described. This is a mud pulser apparatus and is shown in a longitudinal cross-section view in FIG. 1 to which reference should now be made.

Figure 1:
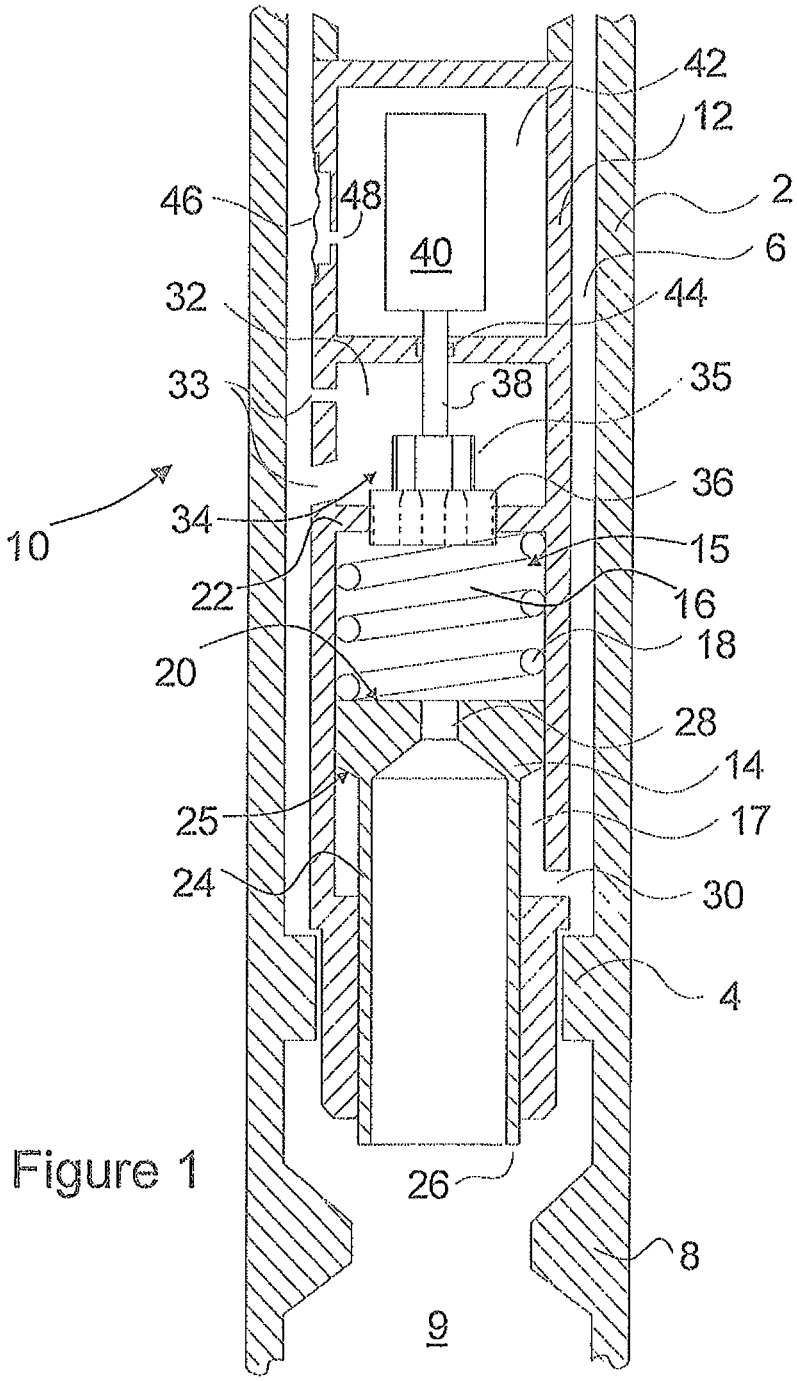
FIG. 1 is a longitudinal cross-section through a preferred mud pulser in accordance with the invention.

FIG. 1 shows a drill pipe BHA 2 in which the preferred mud pulser 10 is deployed. The mud pulser 10 comprises a main housing 12 retrievably located in fins 4 provided in the drill pipe BHA 2. The connection with the drill pipe may also include a mule shoe arrangement, to ensure rotational alignment of directional sensors housed in the mud pulser 10. The main housing is smaller in diameter than the drill pipe so as to create an annulus 6 though which drilling mud can flow. An orifice collar 8 is provided in the drill pipe below fins 4 for creating an orifice or restriction 9 in the flow of drilling mud in the pipe. Drilling mud can therefore flow along the annulus 6 past the fins 4 and orifice collar 8 to exit the BHA and return via the annulus between the drill pipe and the bore hole (not shown).

A main piston 14 is provided within a chamber 15 in housing 12. The piston divides the chamber into upper chamber 16 and lower chamber 17. The piston is acted upon by a compression spring 18 located between the upper face 20 of the piston and chamber wall 22 so that the piston is biased to move downwards towards the orifice 9 in the drill pipe. A hollow cylinder or valve linkage member 24 extends from the lower face 25 of the piston 14 and out of the chamber 16 towards the orifice, so that when the main housing is located by fins 4 in the drill pipe, the open end of the cylinder forms a valve tip 26 that can be moved into the flow of mud through the orifice to create a pressure increase in the mud in annulus 6.

The hollow cylinder 24 communicates with a control port 28 provided in the main piston 14. Thus, mud can flow between the annulus 6 through the valve tip, cylinder and the main piston control port 28 into upper chamber 15. At the same time, a port 30 in the main housing allows drilling mud to enter the lower chamber 17 underneath the piston 14. The structure described so far is similar to that of the device illustrated in U.S. Pat. No. 5,103,430 (Jeter et al.).

A secondary chamber 32 is provide in the housing 12 and is in fluid communication with upper chamber 16 by means of a pilot valve 34 in the chamber end wall 22. Mud from the drill pipe enters the chamber 32 via ports 33. These ports can be made too large to be blocked by LCM and other particulates in the drilling mud, and are also angled to discourage such matter from accumulating.

Pilot valve 34 comprises rotary valve member 35 and valve seat 36. The rotary valve member 35 is mounted on shaft or axle 38, which is turned by motor gearbox or rotary solenoid 40. The motor is contained in motor cavity 42 containing clean fluid and the shaft 38 passes through a seal bearing 44 in the cavity wall such that the cavity remains sealed from the mud. The fluid in the cavity is pressure balanced with the mud in the drill pipe by a membrane 46 in the main housing with which the cavity communicates by port 48. A controller (not shown) send signals to the motor for operation of the rotary valve member. The signals may encode data for transmission to the surface via mud pulse telemetry, or may comprise other operational instructions, such as the initiation of a cleaning cycle as will be described later.

Figure 2:
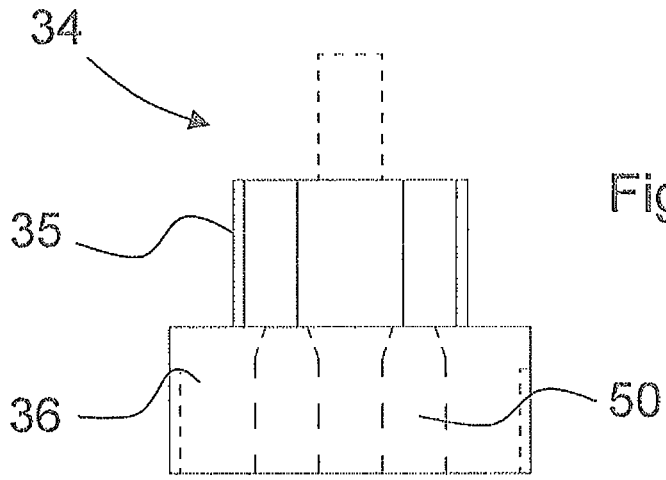
FIG. 2 is a cut-away view of the preferred pilot valve of the mud pulser shown in FIG. 1.
Figure 3:
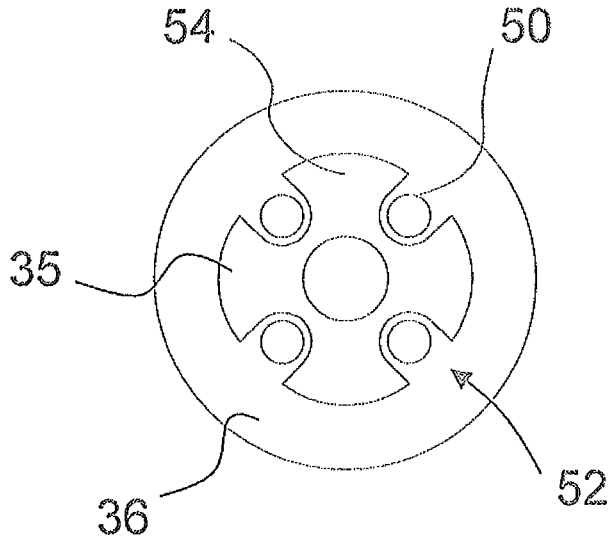
FIG. 3 is a top elevation view of the preferred pilot valve of FIG. 2.

The pilot valve 34 will now be described in more detail with reference to FIGS. 2 and 3. The valve seat 36 comprises a number of valve ports or channels 50 through which mud may flow. The cross-sectional area of the interior of the channels is arranged to be larger than for the opening to the channel, for reasons that will be explained later. The valve seat is located in the wall 22 between upper chamber 15 and secondary chamber 32 such that when the valve 34 is open mud can flow into the upper chamber from secondary chamber 32. The rotary valve member 35 comprises a disc having a number of voids 52 and lobes 54. By rotation of the disc, the lobes can be made to selectively cover or reveal the valve ports 50. Control of the valve is via the motor turning the shaft 38 attached to the disc. The motor is operated under the command of a controller, connected to sensing equipment in the pulser device or on the tool string. The motor is controlled to open and close the pilot valve such that the main valve is operated in a manner that encodes the sensor signals that are to be transmitted.

The compression spring 18 acting on the piston biases the piston to move in the downwards direction towards the orifice. Port 30 maintains the pressure in the lower chamber 17 at the pressure inside the annulus 6, and this pressure exerts an upwards force on the underside of the piston against the compression spring.

The pressure in the upper chamber 16, providing the rotary valve 35 is closed, equalises with the lower pressure below the restriction 9 via the control port 28 and hollow cylinder or valve linkage 24. The action of the spring and the pressure in the upper chamber are relatively weak and the piston will rise due to the pressure in the lower chamber. The restriction at the orifice 9 is thus exposed and the pressure at the orifice reduces until an equilibrium is reached.

When the rotary valve 35 is opened however, mud flow enters the upper piston chamber 15 raising the pressure on the upper surface 20 of main piston 14. The piston moves downwards, moving the valve tip 26 towards the orifice and, by restricting the flow of drilling mud through the orifice 9, increasing the pressure in the drill pipe and annulus 6. The piston continues to move downwards until the pressure in the upper chamber 15 combined with the spring force is balanced by the pressure acting on the piston's lower annular surface which is exposed to the fluid in the lower piston chamber 17. This feature provides a negative feedback and results in stable, proportional control. This downwards balanced position of the piston corresponds to the device's on-pulse state in a binary signalling system.

When the rotary valve is rotated to close the valve ports 50, the flow of mud into the upper chamber is stopped. The pressure in the upper chamber then equalises with that at the valve tip 26. The pressure at the valve tip is lower than the pressure in the narrower annulus 6, so that the pressure in the lower chamber 17 once again becomes higher than the pressure in the upper chamber. The main piston then gradually moves upwards against the action of the compression spring until it adopts its initial or off-pulse position.

The position of the main piston 14 when it has moved fully downwards to its on-pulse position will depend on the characteristics of spring 18, and the ratio of the hydraulic impedances of the control port 28, allowing mud flow between the upper chamber and the hollow cylinder 24 and open valve tip 26, and the valve ports 50, allowing mud flow between the secondary chamber and the upper chamber.

The amount of pressure modulation that can be achieved is critically dependent on the hydraulic impedances of the control port 28 and the valve ports or channels 50. If either of these become blocked, the main piston will not operate correctly and the telemetry provided by the device will fail. This is explained in more detail with reference to FIG. 4.

The operation of the device shown in FIG. 1 is now analysed with certain simplifying assumptions.

It is assumed that the pressure inside the hollow cylinder 24 of piston 14 is the same as the pressure below the restriction 9. This is true when the value tip 26 is fully inserted into the restriction 9, and is nearly true when the value tip 26 is fully retracted away from the restriction 9.

The same assumption applies to the pressure on the thin annular surface of value tip 26 at the bottom of the piston 14.

The absolute pressure below the orifice 9 is taken as the reference from which other pressures are measured. In practice it is a constant pressure due to the hydraulic head and the relatively constant flow into the impedance represented by nozzles in the drill bit. Forces due to this reference pressure can then be ignored, alternatively this pressure can be treated as zero.

Figure 4:
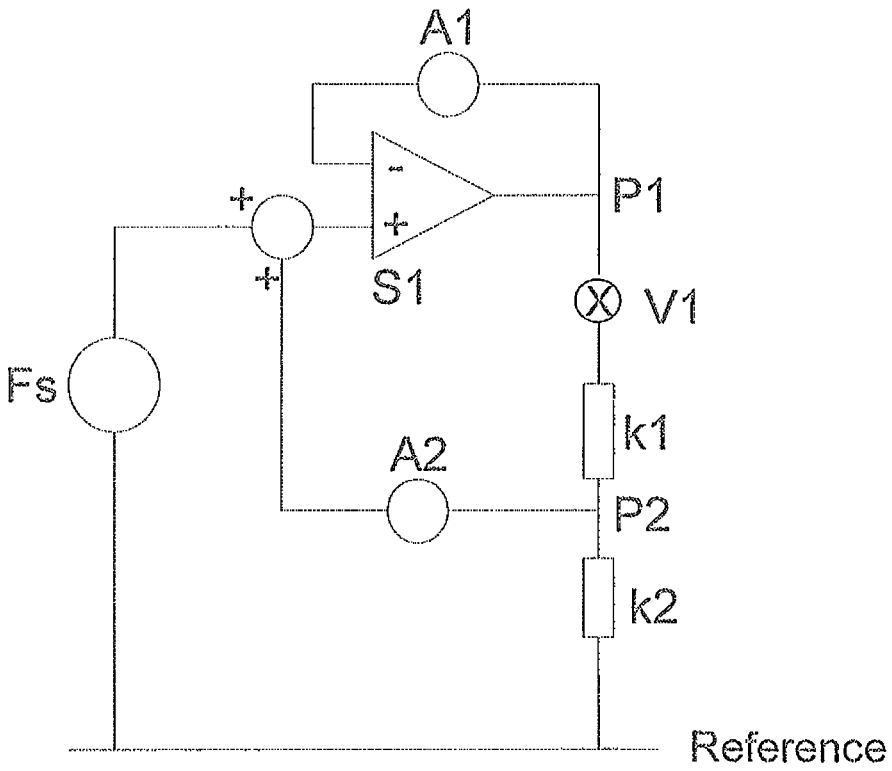
FIG. 4 illustrates by way of an equivalent electrical circuit diagram the operation of the mechanical and hydraulic factors controlling the main valve operation in the mud pulser of FIG. 1.

In FIG. 4 the main orifice 9 and piston 14 are represented by a Servo S1, which creates the pressure P1 in annulus 6 as the piston moves due to any net input forces. Thus a net positive input force causes the piston to move downwards and thereby to increase pressure P1.

The force due to spring 18 is represented as Fs. Initially, it is convenient to assume that the spring is precompressed and exerts a force which is nearly constant, irrespective of the position of piston 14.

A1 is the area of the lower annular surface 25 of piston 14, acted on by the pressure P1 in chamber 17.

A2 is the area of the upper surface 20 of piston 14, acted on by the pressure P2 in chamber 16.

The pilot valve 34 is represented as an on/off valve V1, and the orifices or valve ports 50 are represented as hydraulic impedance k1.

Control part or orifice 28 is represented as hydraulic impedance k2.

When V1 is open, fluid flows through both k1 and k1, and the pressure P2 in upper chamber 16 will depend on the ratio of the two impedances such that $$P2=P1\cdot k2/(k1+k2).$$

When V1 is closed the pressure P2 will drop to the Reference level, treated here as zero.

The forces acting on piston 14, hence the inputs to servo S1, are therefore $$Fs+P2\cdot A2-P1\cdot A1$$

Equilibrium is reached when this net force is zero.

Case 1: V1 is closed, P2=0, therefore $$P1=Fs/A1$$

Case 2: V1 is open, P2=P1·k2/(k1+k2) therefore $$Fs+P1\cdot k2\cdot A2/(k1+k2)-P1\cdot A1=0$$

and $$P1=Fs/(A1-A2\cdot k2/(k1+k2))$$

Note the restriction that A1>A2·k2/(k1+k2), otherwise the negative, self regulating feedback is not present, and the system would no longer self-adjust in case 2. It is this self-adjustment that renders the system independent of total flow rate. As a result, the signal valve is compensated for variable flowrates.

Now consider the result in case 2, and treat k1 together with V1 as a variable orifice, such that the value k1 in the above equation is infinite when fully closed.

The system then becomes a proportional control system, allowing the variable aperture of the rotary pilot valve to generate complex waveforms with amplitudes which are essentially independent of the mud flow rate.

It will be appreciated that a more thorough analysis would take account of the variable spring force, which would have the effect of raising pressure P1 slightly as higher flow rates demand that a different equilibrium position is found. Also the pressure inside the hollow cylinder of the piston 14 may not be always at the constant reference level, due to orifice flow and Bernoulli effects. They may allowed for in a more detailed model, or measured experimentally for a given design. However, the proportionality and self regulation effects may be seen to remain, and the usefulness of the system is not impaired.

We have therefore appreciated that it is critical to the operation of the device that the relationship between the impedances k1 and k2 be maintained. Once the piston has been put in place and the area values A1 and A2 fixed, the most likely way that the ratio of impedances will be affected, will be due to the build up of LCM or other particulate matter in one or more of the control or valve ports. The rotary pilot valve provided in the preferred embodiment of the invention therefore gives a significant advantage of prior art devices, as the rotational movement of the valve disc acts to shear off any blockages that are obstructing the valve ports.

In particular, the rotary valve disc is mounted for rotational movement across the openings of the one or more ports, so that it cooperates with the valve seat and the port openings to ensure that a cutting action takes place. The edge of the valve disc may be sharpened or reinforced in order to facilitate the cutting action.

The valve ports are relatively small, and any blockage that is sheared off may then fall through into the upper chamber. The cross-sectional area of the interior of the ports is made larger than that of the openings to the ports, to ensure that any blockages that are sheared off and enter the channel will be small enough to pass through without becoming stuck. Furthermore, in the preferred embodiment, the individual valve ports 50 have a smaller cross-sectional area than that of the control port 28 in the main piston 14. Thus, any LCM or other particulate matter that can fall through the valve ports, will be small enough to pass unhampered through the control port and out of the device. By using small, multiple ports 50 in a rotary valve configuration, it is therefore possible to achieve a mud pulser that operates without a filter that may itself become blocked, and which maintains correct hydraulic operation. The ports 50, and the rotary valve 36 therefore constitute an effective self cleaning filter, while presenting the correct hydraulic impedance relative to command port 28.

The rotary valve may be operated in a number of different ways within a signalling scheme. For example, in the example shown the valve disc has 4 way symmetry and an on pulse to off pulse transition can be obtained by rotating the disc through just 45°. However, from the point of view of ensuring the removal of debris that could block the valve, it may be preferable that the valve disc rotates through a greater angle before reaching the new signalling state. For an on pulse to off pulse transition, the valve disc could for example rotate by 405° or more. Of course, there will always be a minimum rotation required depending on the rotational symmetry of the disc, and a preferred angle of rotation depending on the type of debris likely to be encountered and the need to clear this from the valve. In practice therefore, this needs to be set depending on the environment and so in general may be varied by an integer multiple of the angle between the lobes. Thus, providing the angle is greater than the angular displacement between two successive lobes, some additional shearing action will be provided. The preferred device preferably also provides a cleaning cycle in which the valve disc is spun for a period of time sufficient to clear the valve of substantially any blockage material.

Since the mud pulser produces a pressure increase in the drill pipe that is proportional to the impedances of the ports, it is possible to control the rotary valve to produce complex modulation as well as simple binary pulses. Amplitude modulation for example can be achieved by opening the rotary valve a fraction of its fully opened state so that a smaller pressure pulse is created. Modulation schemes may use amplitude, phase or frequency, or combinations of all three therefore in order to maximise the data rate. The advantages of providing a more sophisticated signalling scheme are readily apparent.

In an alternative embodiment, a signalling scheme based on a mark-space ratio of the valve disc lobes to the port openings is used. In this scheme, the valve disc is spun or oscillated continuously, so that the pressure in the upper chamber has insufficient time to reach equilibrium with the pressure of either of the fully open or fully closed valve states. The effective impedance of the pilot valve then becomes an intermediate valve, dependent on the mark-space ratio of open to closed, while the self-clearing property is maintained.

Although, the preferred embodiment shows a disc with four way symmetry, it will be appreciated that in alternative embodiments rotary valves of different shapes and configurations could be used. Only one port or channel may be provided in the valve seat for example. If the valve disc was spun continuously, this would still provide a self-cleaning action. However, a plurality of smaller ports are preferred because it means that the debris is ultimately cut into smaller pieces before it can fall into the subsequent restriction.

Prior art rotary mud pulsers are known, such as from U.S. Pat. No. 5,787,052. However, in such devices the pressure generated depends on the both the valve position and the mud flow rate. As the mud flow rate may often be varied by drill operators, according to environmental conditions, the devices can be difficult to operate reliably. Furthermore, such devices can consume significant electrical energy as the relatively large rotary vanes have to be moved under electric power each time a signal is to be transmitted, and such vanes are subject to forces from the whole mudstream. If a high flow rate is required for the drilling conditions, the vanes must not be fully closed, or the mudstream will be excessively obstructed.

It will be appreciated from the above analysis however that in the preferred embodiment, the amplitude of the pressure modulation is essentially independent of the main mud flow rate in the bore hole, and only a function of the pilot valve impedance. The preferred embodiment therefore comprises a hydraulic amplifier: an input signal provided by the pilot valve is used to control a larger valve that provides a larger output signal; the forces on the larger valve are balanced so that the small input can change the status quo, and be amplified. This arrangement allows the preferred embodiment to operate using considerably less electrical power, as well as over a wide range of flow rates without intervention being required. Other forms of variable pilot valves with cutting action could be used. These may include a rotary, linear, or reciprocating cylindrical sleeve valve, driven in the latter case by a lead screw arrangement, a rotary vane valve, rotary or any slide valve, arranged for variable opening. All of these valves advantageously operate using a valve member that has direction of opening or closing that is orthogonal to the direction of fluid flow through the pilot valve.

Other forms of hydraulic amplifier could be used in conjunction with the variable pilot valve in order to produce pressure waveforms. All that is necessary is a two valve arrangement having a signalling valve and a pilot valve, and in which the forces on the signalling valve are balanced and controlled by the flow from the pilot valve. The main valve may be a piston or diaphragm for example, while the pilot valve should be perform as a variable orifice of the types described.

Although, the invention has been described with reference to a preferred embodiment of a mud pulser in a MWD device, the device for creating pulses in the fluid of a bore hole according to the invention could also be used in connection with permanently installed monitoring systems in a producing well or an injecting well.

The invention claimed is:

1. A device for creating pressure pulses in the fluid of a bore hole, the device comprising:

a housing for deployment in a bore hole, the housing having a chamber, and a piston mounted within the chamber for reciprocal motion along a longitudinal axis of the device, wherein the piston has first and second opposing faces and forms a first variable volume chamber between the first opposing face and a first end wall of the chamber, and a second variable volume chamber between the second opposing face and a second end wall of the chamber;

a hollow valve linkage member, mounted on the second opposing face of the piston, and extending out of the second end wall of the chamber towards a fluid flow restriction in the bore hole, the hollow valve linkage member being in fluid communication with the bore hole fluid in the vicinity of the restriction via an opening in the hollow valve linkage member, and wherein the end of the hollow valve linkage member outside of the chamber forms a valve tip arranged to cooperate with the fluid flow restriction to create a pressure pulse in the fluid according to the position of the piston;

a control port in the piston providing a fluid communication path between the hollow valve linkage member and the first variable volume chamber; biasing means, located in the chamber for biasing the piston away from the first end wall of the chamber, towards the fluid flow restriction;

a port in the chamber wall providing fluid communication between the bore hole and the second variable volume chamber, wherein the pressure of fluid pressure in the second volume variable chamber acts against the biasing means;

a pilot valve in the first end wall of the chamber, which when open provides a fluid communication path between the bore hole and the first variable volume fluid chamber, and when closed shuts the fluid communication path; and a controller for controlling the pilot valve;

wherein the pilot valve comprises a valve seat and a valve member, wherein the valve seat comprises one or more valve ports through which fluid can flow, each valve port having an opening, and wherein the valve member is mounted for movement in a direction across the openings of the one or more valve ports to respectively reveal or block the one or more valve ports.

2. The device of claim 1, wherein the valve member is arranged for translational motion in the plane of the valve port openings.

3. The device of claim 1, wherein the pilot valve is a rotary pilot valve having a rotary valve member arranged for rotational motion in the plane of the valve port openings.

4. The device of claim 3, wherein the rotary valve member is a disc having a plurality of lobes and voids for blocking or revealing the plurality of valve ports.

5. The device of claim 4, wherein the disc has four lobes and four voids for covering or revealing respective valve port openings located in the valve seat.

6. The device of claim 4, wherein the controller is arranged to spin the disc to transition from an open state to a closed state by an angle that is greater than the angular displacement between two successive lobes.

7. The device of claim 4, wherein the controller is arranged to spin the disc through one or more complete revolutions in a cleaning cycle.

8. The device of claim 4, wherein the controller is arranged to spin the disc continuously, and encode information by varying the speed of rotation of the disc.

9. The device of claim 1, wherein a cross-sectional area of each respective valve port in the valve seat is less than the cross-sectional area of the control port in the piston.

10. The device of claim 1, wherein a cross-sectional area of the interior of the ports in the valve seat is larger than the cross-sectional area of the valve port opening.

11. The device of claim 1, wherein the area A2 of the first opposing face of the piston, the area A1 of the second opposing face of the piston, and the hydraulic impedances k1 and k2 of the valve ports and the control port respectively satisfy the inequality $$A1 > A2 \cdot k2/(k1+k2)$$

12. The device of claim 1, wherein the pilot valve is a rotary vane valve, rotary or linear sleeve valve, or any slide valve, arranged for variable opening.

* * * * *